US005841405A

United States Patent [19]

Lee et al.

[11] Patent Number: 5,841,405

[45] Date of Patent: Nov. 24, 1998

[54] OCTAVE-BAND ANTENNAS FOR IMPULSE RADIOS AND CELLULAR PHONES

[75] Inventors: J. J. Lee, Irvine; Stan W. Livingston, Fullerton, both of Calif.

[73] Assignee: Raytheon Company, Lexington, Mass.

[21] Appl. No.: 636,621

[22] Filed: Apr. 23, 1996

[51] Int. Cl.[6] ..... H01Q 21/00

[52] U.S. Cl. ..... 343/795; 343/767; 343/770

[58] Field of Search ..... 343/700 MS, 767, 343/795, 797, 846

[56] References Cited

U.S. PATENT DOCUMENTS

| | | | |
|---|---|---|---|
| 3,747,114 | 7/1973 | Shyhalla | 343/795 |
| 3,887,925 | 6/1975 | Ranghelli et al. | 343/795 |
| 4,644,361 | 2/1987 | Yokoyama | 343/700 |
| 4,978,965 | 12/1990 | Mohvehy | 343/795 X |
| 5,428,364 | 6/1995 | Lee et al. | 343/767 |
| 5,519,408 | 5/1996 | Schnetzer | 343/770 X |

*Primary Examiner*—Donald T. Hajec
*Assistant Examiner*—Tho Phan
*Attorney, Agent, or Firm*—Glenn H. Lenzen, Jr.; Leonard A. Alkov

[57] ABSTRACT

An omnidirectional antenna structure that includes oppositely facing, parallel first and second planar dipole arrays (11, 12), each dipole array including side by side substantially identically shaped planar dipole elements (110) having expanded shape dipole wings (51*c*, 52*c*). Also disclosed is a sectorial coverage antenna that includes a single planar array of side by side substantially identically shaped planar dipole elements having expanded shape dipole wings.

3 Claims, 2 Drawing Sheets

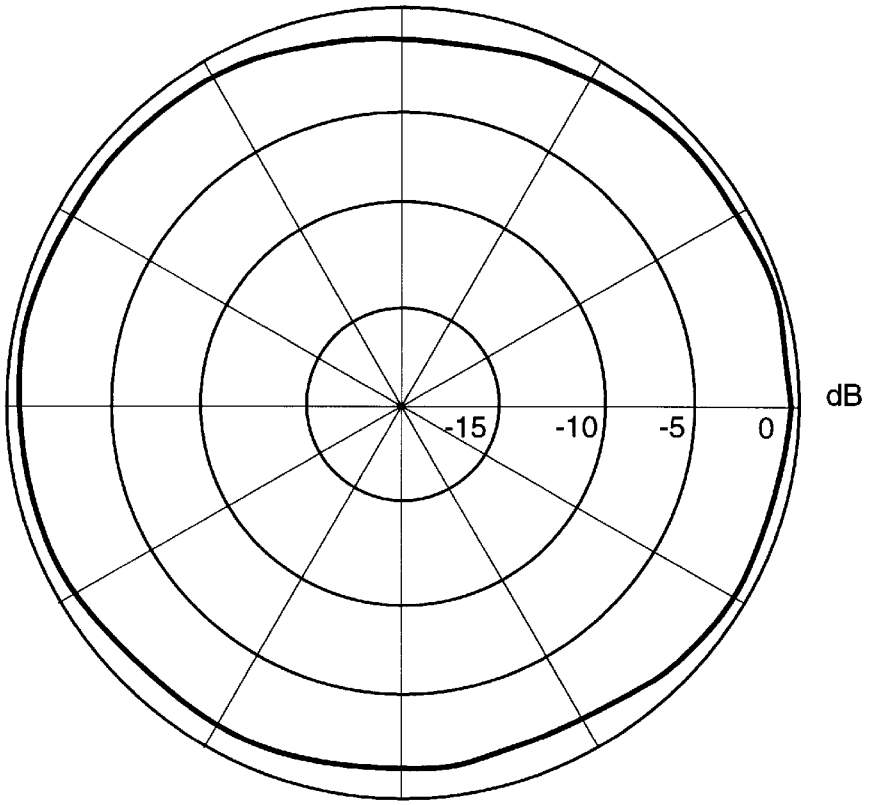
FIG. 3.
FIG. 4.
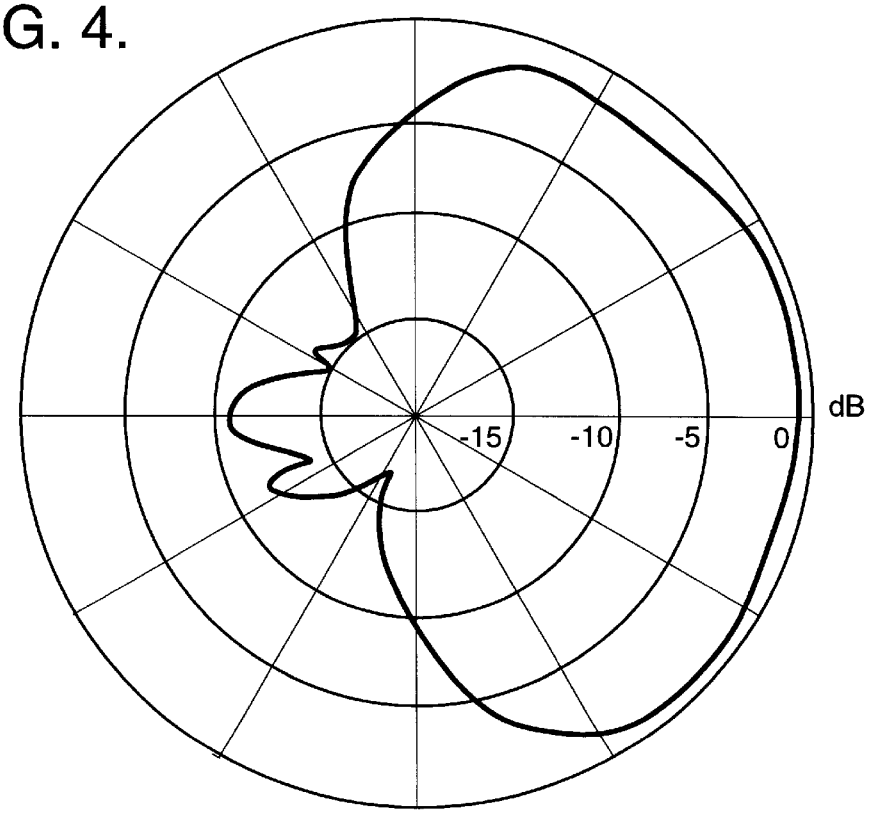

OCTAVE-BAND ANTENNAS FOR IMPULSE RADIOS AND CELLULAR PHONES

BACKGROUND OF THE INVENTION

The disclosed invention relates generally to antenna structures, and more particularly to an antenna structure that is useful for impulse type cellular phones and radios.

In the field of wireless personal communications systems, one technique that has been developed is impulse radio wherein information is conveyed by the timing of pulses of short duration (e.g., one nanosecond). The bandwidth of impulse radio is relatively wide (e.g., 1 to 2 GHz), but the power density is relatively low across the entire bandwidth.

A consideration with impulse radio is the requirement for a wide bandwidth antenna. While there are many available cellular antennas, none can provide the required impulse radio bandwidth in a compact design. Bicone elements may be used in impulse radio applications, but the form factor is bulky and unsuitable for easy packaging.

SUMMARY OF THE INVENTION

It would therefore be an advantage to provide an improved antenna structure for impulse type cellular and radio applications.

Another advantage would be to provide an antenna structure for impulse type cellular and radio applications that is easily packaged for shipment and storage.

The foregoing and other advantages are provided by the invention in an omnidirectional antenna structure that includes oppositely facing, parallel first and second planar dipole arrays, each dipole array including side by side substantially identically shaped planar dipole elements having expanded shape dipole wings. In accordance with a further aspect of the invention, a sectorial coverage antenna includes a single planar array of side by side substantially identically shaped planar dipole elements having expanded shape dipole wings.

BRIEF DESCRIPTION OF THE DRAWINGS

The advantages and features of the disclosed invention will readily be appreciated by persons skilled in the art from the following detailed description when read in conjunction with the drawing wherein:

FIG. 3 is a typical azimuthal (i.e., horizontal) antenna radiation pattern for frequencies ranging from 1.1 to 2.7 GHz for an omnidirectional antenna structure in accordance with the invention.

FIG. 4 is a typical azimuthal antenna radiation pattern for frequencies ranging from 1.1 to 2.7 GHz for a sectorial coverage antenna structure in accordance with the invention.

DETAILED DESCRIPTION OF THE DISCLOSURE

Figure 1:
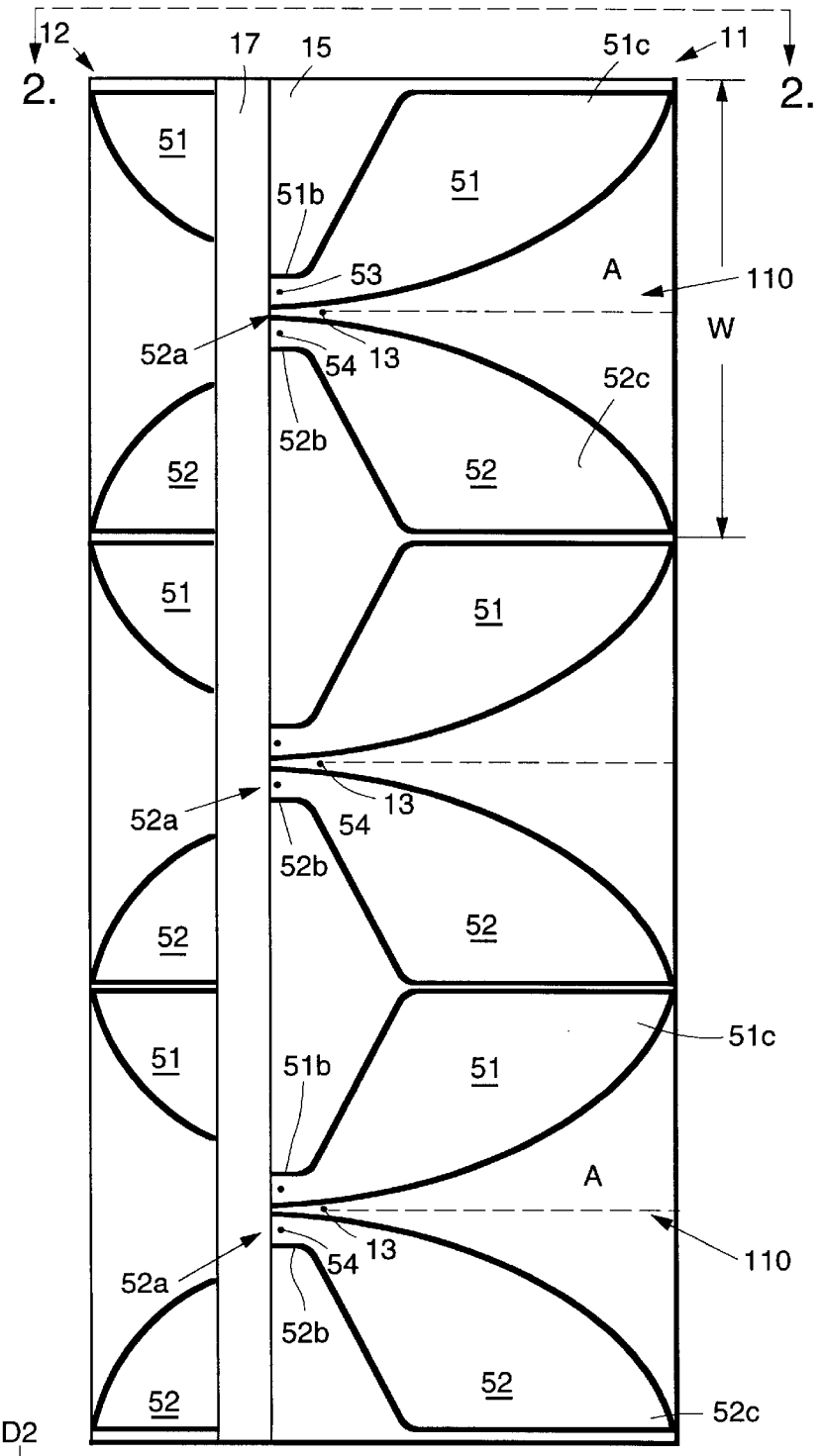
FIG. 1 is an elevational view of an antenna structure in accordance with the invention.

In the following detailed description and in the several figures of the drawing, like elements are identified with like reference numerals.

Figure 2:
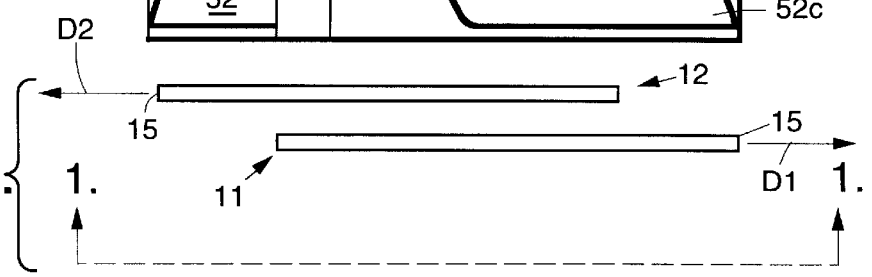
FIG. 2 is a top plan view of the antenna structure in accordance with the invention.

Referring now to FIGS. 1 and 2, set forth therein are an elevational view and a top plan view of an omnidirectional antenna structure in accordance with the invention that includes first and second substantially identical planar dipole arrays 11, 12 of substantially identically shaped expanded dipole elements 110. Each of the dipole arrays 11, 12 includes an identical number N of substantially identically expanded shape dipole elements 110 arranged side by side such that the radiating apertures of the expanded dipole wings of the elements 110 of an array face in the same direction. The arrays 11, 12 are parallel to each other and positioned such that the radiating apertures of the array 11 are facing in a direction D1, and the radiating apertures of the array 12 are facing in a direction D2 which is opposite the direction D1, and such that the phase center 13 of each dipole element 110 of the first array 11 and the phase center of a corresponding dipole element of the second array 12 form a line that is orthogonal to the planar extent of the planar dipole arrays 11, 12.

As more particularly shown in FIG. 1, each of the arrays 11, 12 comprises a planar dielectric substrate 15 on which are formed a power divider 17 along a length edge of the dielectric substrate 15, and a pair of symmetrical expanded shape planar conductors 51, 52 for each dipole element 110. In particular, each planar conductor 51 is comprised of planar conductive regions symmetrically formed opposite each other on the opposing sides of the planar dielectric substrate 15 and interconnected by a conductive via 53. Similarly, each planar conductor 52 is similarly comprised of planar conductive regions formed opposite each other on the opposing sides of the planar dielectric substrate 13 and interconnected by a conductive via 54. Thus, one side of each of the planar arrays 11, 12 is substantially identical to the other side.

The planar conductors 51, 52 of each dipole element 110 include laterally narrow transition section conductors 51*b*, 52*b* that extend forwardly away from feed ends 51*a*, 52*b* and merge with laterally wider, expanded shape, tapered dipole wing conductors 51*c*, 52*c* that extend forwardly from the narrow transition section and have a greater lateral extent than the narrow transition section. The planar conductors 51, 52 are symmetrical about a central axis A and include facing edges that curvedly diverge away from each other with distance along the central axis A from the feed ends 51*a*, 52*a* of the planar conductors which are appropriately connected to the power divider 17 in a conventional manner. In other words, each dipole element 110 includes a pair of symmetrical planar conductors that extend away from feed ends of the planar conductors and have facing edges that diverge away from each other with distance from the feed ends along the central A axis to form a radiation aperture between the facing edges, the symmetrical planar conductors including (a) a pair of transition section conductors that extend away from the feed ends and (b) a pair of expanded shape dipole wing conductors that extend from the transition section and which have a lateral extent that is greater than the lateral extent of the transition portion. The lateral extent W of the wider forward section of each dipole element 110 is, for example approximately a quarter of the wavelength at midband.

By way of illustrative example, each of the dipole elements 110 is constructed similarly to the wideband expanded shape dipole radiating element disclosed in U.S. Pat. No. 5,428,364, incorporated herein by reference.

The antenna structure of FIG. 1, which includes two parallel, oppositely facing, back to back planar arrays 11, 12, provides omnidirectional coverage. In accordance with a further aspect of the invention, a single planar array 11 or 12 can be utilized by to provide sectorial coverage. In such application, which utilizes a single planar array of side by side expand shape dipole wings, the lateral extent W of the wider forward section of each dipole element 110 is approximately three-fourths of the wavelength at midband.

Thus, omnidirectional coverage is provided by two parallel, oppositely facing, back to back planar arrays 11, 12 of expanded shape dipole elements having a lateral extent W of one-fourth of the wavelength at midband, while sectorial coverage is provided by a single planar array of expanded shape dipole elements having a lateral extent W of three-fourths of the wavelength at midband. FIG. 3 schematically depicts a typical azimuthal (i.e., horizontal) antenna radiation pattern for frequencies ranging from 1.1 to 2.7 GHz for an omnidirectional antenna in accordance with the invention. FIG. 4 schematically depicts a typical azimuthal antenna radiation pattern for frequencies ranging from 1.1 to 2.7 GHz for a sectorial coverage antenna in accordance with the invention.

The foregoing has thus been a disclosure of an improved antenna structure for impulse type cellular and radio applications that provides the requisite bandwidth and is easily packaged for shipment and storage.

Although the foregoing has been a description and illustration of specific embodiments of the invention, various modifications and changes thereto can be made by persons skilled in the art without departing from the scope and spirit of the invention as defined by the following claims.

What is claimed is:

1. An antenna comprising:

a first planar array of N side by side substantially identical first expanded shape dipole elements, each first expanded shape dipole element including a pair of symmetrical planar conductors that extend away from feed ends of the planar conductors and having facing edges that diverge away from each other with distance from the feed ends along a central axis to form a radiation aperture between the facing edges, said symmetrical planar conductors including (a) a pair of transition section conductors that extend away from the feed ends and (b) a pair of expanded shape dipole wing conductors that extend from the transition section conductors and which have a lateral extent that is greater than a lateral extent of the pair of transition section conductors;

said first expanded shape dipole elements being arranged with respective central axes parallel to each other and with the radiation apertures facing in a first direction;

a second planar array of N side by side substantially identical second expanded shape dipole elements which are substantially identical to said first substantially identical first expanded shape dipole elements, each second expanded dipole element including a pair of symmetrical planar conductors that extend away from feed ends of the planar conductors and having facing edges that diverge away from each other with distance from the feed ends along a central axis to form a radiation aperture between the facing edges, said symmetrical planar conductors including (b) a pair of transition section conductors that extend away from the feed ends and (b) a pair of expanded shape dipole wing conductors that extend from the transition section conductors and which have a lateral extent that is greater than a lateral extent of the pair of transition section conductors;

said second expanded shape dipole elements being arranged with respective central axes being parallel and with the radiation apertures facing in a second direction that is opposite said first direction;

said first planar array and said second planar array being parallel to each other and positioned such that each phase center of the first planar array and a corresponding phase center of the second planar array is on a line that is orthogonal to the planar extent of the first planar array and the second planar array.

2. The antenna of claim 1 wherein said first expanded shape dipole elements comprise conductors symmetrically formed on opposite sides of a first planar dielectric substrate, and wherein said second expanded shape dipole elements comprise conductors symmetrically formed on opposite sides of a second planar dielectric substrate.

3. The antenna of claim 1 wherein each pair of expanded shape dipole wing conductors has a lateral extent that is approximately one-quarter of a wavelength at midband.

* * * * *